United States Patent [19]

Segonne

[11] Patent Number: 4,515,515

[45] Date of Patent: May 7, 1985

[54] COMPRESSOR SERVOMECHANICAL REGULATOR

[75] Inventor: Jean-Marc Segonne, Meyzieu, France

[73] Assignee: 501 Maco Meudon Chemin de Genas, France

[21] Appl. No.: 436,909

[22] Filed: Oct. 27, 1982

[30] Foreign Application Priority Data

Oct. 27, 1981 [FR] France ..... 81 20542

[51] Int. Cl.[3] ..... F04B 49/02

[52] U.S. Cl. ..... 417/26; 417/34; 417/295

[58] Field of Search ..... 417/295, 26, 34, 318

[56] References Cited

U.S. PATENT DOCUMENTS

| | | | |
|---|---|---|---|
| 2,665,839 | 1/1954 | Ostwald | 417/295 X |
| 2,961,147 | 11/1960 | Osterkamp | 417/295 X |
| 3,602,610 | 8/1971 | Bloom | 417/295 X |
| 4,362,475 | 12/1982 | Seitz | 417/295 |

*Primary Examiner*—Richard E. Gluck

*Attorney, Agent, or Firm*—Remy J. VanOphem

[57] ABSTRACT

The invention relates to an air intake regulator for a compressor. The pressure in an oil separator is sent into the rear chamber of a jack having a membrane, which controls the acceleration or the slowing of a motor driving a compressor. A front chamber is placed under compression by the intake of the compressor. A selectively operable valve selectively interrupts the flow of air drawn in through an air filter.

20 Claims, 2 Drawing Figures

COMPRESSOR SERVOMECHANICAL REGULATOR

BACKGROUND OF THE INVENTION

The present invention relates to an inlet valve assembly fitted with a servo-control for opening and closing, and intended for fitting to the inlet of a lubricated screw compressor principally adapted for producing compressed air.

According to the demands of compressed air needed by the tools in use, it will be necessary for a compressor to furnish a volume of air which is variable in relation to the use.

To attain this objective, generally both the angle of opening of a butterfly valve located in the inlet channel of the compressor and the acceleration lever of the motor are adjusted, these two components being often rigidly connected in such a way that the closing of the butterfly causes the slowing of the motor and vice versa.

The control of the butterfly is generally carried out by a pneumatic jack controlled by the air pressure obtaining at the outlet of the compressor through a proportional regulator. As soon as a predetermined pressure threshold is reached at the compressor outlet, the regulator activates the jack which slows the motor and simultaneously operates the inlet butterfly valve until the latter obstructs the inlet opening, in such a way that the volume then produced by the compressor causes no further increase in pressure in the separator situated at the outlet of the compressor. Under these conditions, the volume of air delivered by the compressor corresponds exactly to the demands of the tools fed by the compressor. Such type of regulation is said to be proportional and continuous.

The above described regulator nevertheless presents the disadvantage of needing many components such as the jack, the regulator, and the butterfly valve member which must be mechanically connected and regulated. In addition, since a butterfly never provides a perfect seal, it is necessary to add to the air-oil and oil circuits of the lubricated screw compressors an anti-return valve and an oil stop valve, respectively, to close the circuits in case of compressor stoppage. Thus, oil is prevented from flowing back into the inlet and, more precisely, into the inlet filter by the effect of the pressure existing in the separator, principally when this stoppage occurs with the valves closed, as is generally the case.

In addition, since the butterfly valve member never gives a perfect seal, the compressor continues to take in air and produce an output, even with the butterfly valve member closed and the motor completely decelerated. This causes useless consumption of energy to compress air which must then be spilled through a release valve if the compressor continues to run while none of the tools to be supplied are operating.

A second type of regulation is provided by a second type of valve, wherein the inlet is either totally open or totally closed by the valve. The speed of the motor is similarly controlled, that is, the engine is either fully accelerated or fully slowed.

The second type of valve has the inconvenience of causing a continual opening and closing of the inlet valve as well as sudden accelerations and slowings of the motor, causing an excessive consumption of fuel or energy when the demand for compressed air does not correspond to the maximum volume which may be delivered by the compressor.

The primary object of the present invention is avoiding these disadvantages, by offering an inlet regulator having a reduced number of parts, all grouped in a compact unitary subassembly.

SUMMARY OF THE PRESENT INVENTION

The inlet regulator according to the invention is intended for fitting to a compressor, and principally a screw compressor, which takes in a gas through a filter and expels it after compression into a tank.

The inlet regulator has a body fixed on one side to the inlet flange of the compressor and accepting on the other the inlet filter. The body also has a seat which can cooperate with a valve. A regulating block having a regulator, an outlet to the atmosphere of the pilot pressure through a jet, and a facility for emptying the tank, in case of compressor stoppage with the valve closed, is also provided.

The inlet regulator further includes a control jack having a sealed flexible membrane and a valve stem fitted at the rear end with a piston upon which the membrane acts. A reciprocable valve propelled towards the seat in the body by a spring is movably mounted to the stem. The stem is biased towards the membrane by a spring interposed a shoulder of the stem and one of the walls of the body. In addition, the stem passes through an aperture in one of the walls of the body and forms a seal therebetween. The other end of the stem is interconnected with the speed regulating lever of the drive motor of the compressor to regulate the speed of the motor as the stem moves.

In the preferred embodiment, a sealed flexible membrane forms a seal between the inlet body and the regulating block, and cooperates with a piston attached to the jack stem. The regulating block has a regulator composed of a sealing disc, a thrust spring and a screw for regulating the pressure of the spring. A jack chamber is open to the atmosphere through a controllable jet. An emptying valve is held closed by a spring and works in conjunction with a sealed membrane by means of a control stem.

The many objects, features and advantages of the present invention will become apparent to those skilled in the art after reading the following detailed description and reviewing the attached drawings.

DETAILED DESCRIPTION OF THE PREFERRED EMBODIMENT

Figure 1:
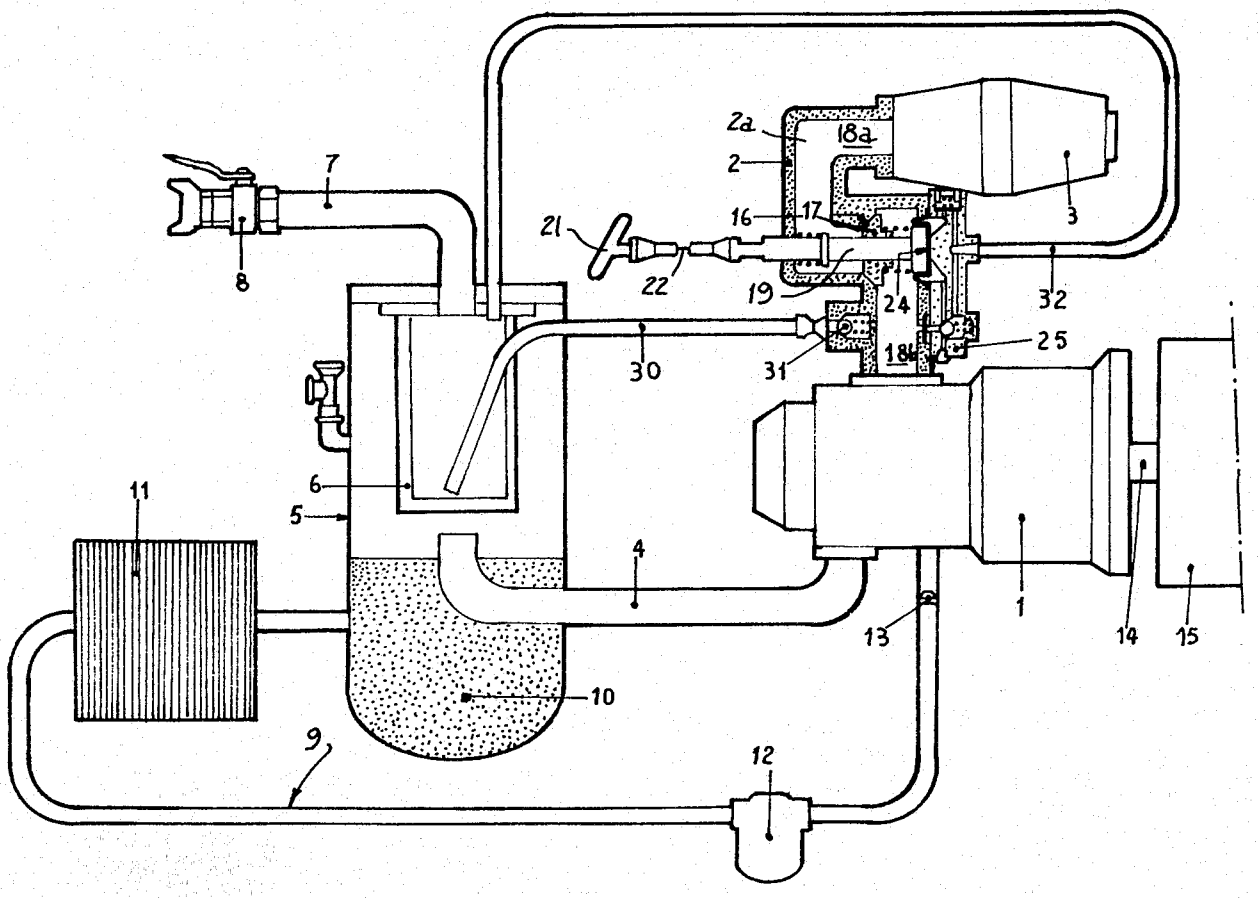
FIG. 1 is an overall view of the air, air-oil, and oil and air circuits of a lubricated screw compressor. In this figure, the separator and the inlet regulator according to the invention are shown in cross-section.

Referring now to the drawing and, more particularly, to FIG. 1 thereof, there is shown a screw compressor 1 which, through an inlet body 2 having an inlet channel 2*a* therethrough, takes in atmospheric air through a filter 3. The air is compressed in the compressor 1 and sent through an intermediate channel 4 into an oil separator 5, well known in the art. A filter cartridge 6, disposed in the upper part of the oil separator 5, completes the air-oil separation, so as to supply the compressed air, which is practically free from oil, to an outlet channel 7.

At the end of the outlet channel 7, an output valve 8 is provided which may be connected to conventional tools operating by compressed air, not shown in the drawing but well known in the art.

Under the effect of the pressure existing in the oil separator 5, the decanted oil, collected in the lower part 10 of the oil separator, is returned to the screw compressor 1, along an oil return circuit 9 moving the oil successively through a cooler 11, an oil filter 12 and a jet 13 to lubricate the screw compressor.

The screw compressor 1 also has a drive shaft 14 driven by a motor 15.

Figure 2:
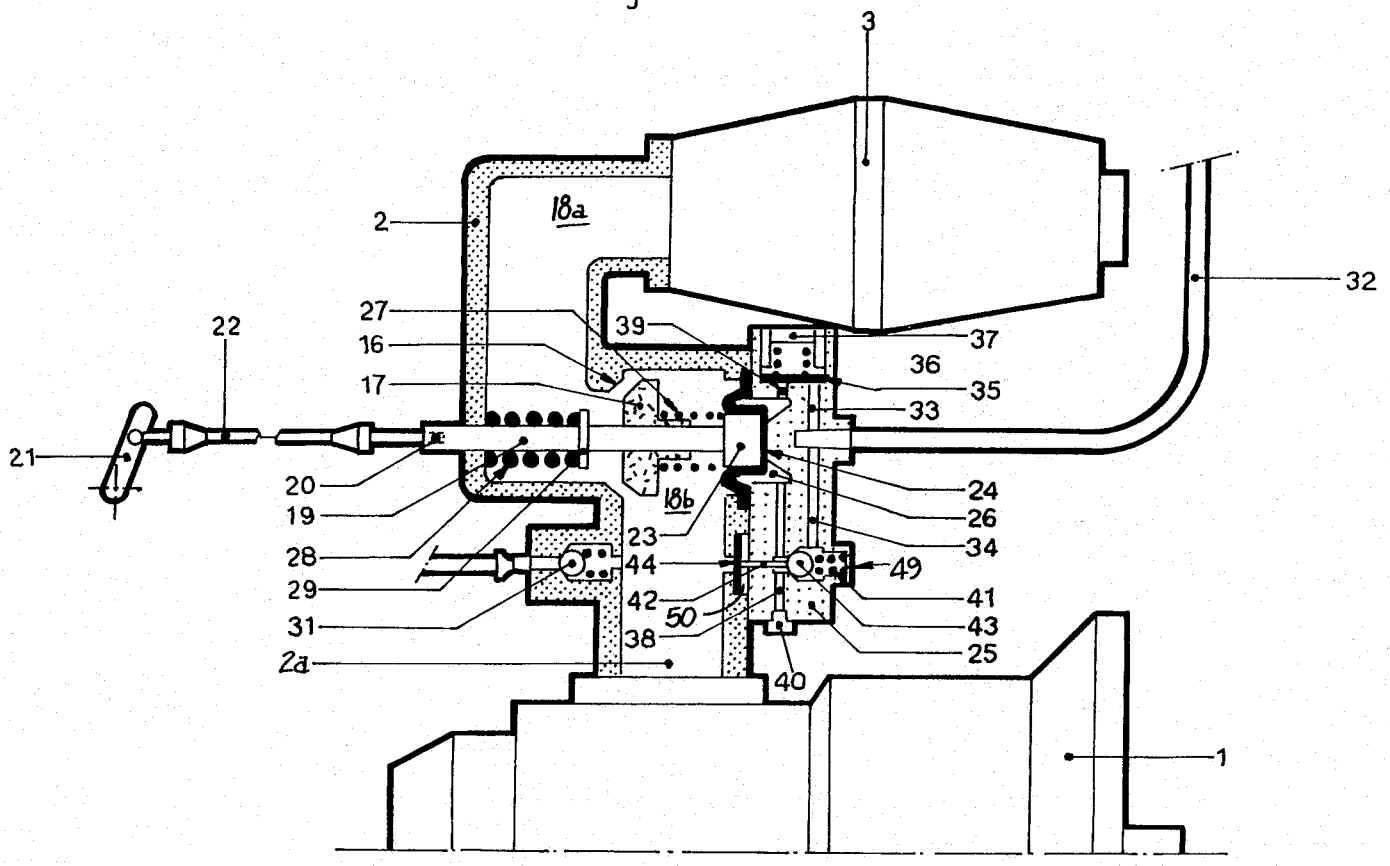
FIG. 2 is a cross-sectional view showing, on an enlarged scale, the detail of the inlet regulator, the valve being in the open position.

Referring now to both FIGS. 1 and 2, a frusto-conical seat 16 is formed inside the inlet body 2. A reciprocating frusto-conical valve member 17 is provided to selectively rest against the frusto-conical seat 16. When the reciprocating frusto-conical valve member 17 bears on the frusto-conical seat 16, it forms a seal separating the inlet channel 2*a* through the inlet body 2 into two chambers 18*a* and 18*b*. One chamber 18*a* is located between the frusto-conical valve member 17 and the filter 3. The other chamber 18*b*, hereafter called the front chamber, is located between the frusto-conical valve member 17 and the screw compressor 1.

The frusto-conical valve member 17 slides freely on a jack stem 19 of a jack. One end 20 of the jack stem 19 passes through a suitable aperture in the wall of the inlet body 2, forming a sliding seal therein. The one end 20 is connectesd to the acceleration control 21 of the motor 15 by a cable 22.

A piston 23 is affixed to the other end of the jack stem 19. The piston 23 selectively bears against a flexible sealed membrane 24. The rim of the flexible sealed membrane 24 is trapped so as to form a seal between the inlet channel 2*a* of the inlet body 2 and a regulating block 25. Beind the flexible sealed membrane 24 and in the regulating block 25, there is formed a cavity 26 hereafter referred to as the jack chamber.

A weak first return spring 27 is wound around the jack stem 19 and is interposed the piston 23 of the jack stem 19 and the frusto-conical valve member 17. The first return spring 27 biases the frusto-conical valve member 17 towards the frusto-conical seat 16.

A shoulder 29 is formed in the jack stem 19 between the frusto-conical valve member 17 and the cable 22 within the chamber 18*a*. A second return spring 28 is wound around the jack stem 19 of the jack and is interposed the wall of the inlet body 2 and the shoulder 29. The second return spring 28 biases the jack stem 19 towards the jack chamber 26.

As shown in FIG. 1, a drain 30, under the effect of the pressure existing in the oil separator 5, returns the oil which is deposited at the bottom of the filter cartridge 6 of the oil separator 5 to the front chamber 18*b* of the inlet body 2 through a one-way valve 31.

Refer now to FIG. 2 wherein certain details of the regulating block 25 are illustrated.

A conduit 32 maintains the pressure in the regulating block 25 at the same level as the pressure in the oil separator 5. The conduit 32 opens into channels 33 and 34 in the regulating block 25. At its upper end, the channel 33 is blocked by a sealing disc 35 which is held on its seat by a spring 36, the force of which is selectively adjusted by means of the screw 37, shown schematically in the drawing.

Another channel 39 in the regulating block 25 brings the jack chamber 26 into communication with the channel 33 when, under the effect of the pressure in these channels, the sealing disc 35 is raised. As illustrated in FIG. 2 of the drawing, the channel 39 extends from the jack chamber 26 to the sealing disc 35.

Finally a channel 38 extending from the jack chamber 26 provides communication with the atmosphere through an adjustable relief jet 40.

In addition, the regulating block 25 includes a device, shown generally at 49, for emptying the oil separator 5. The device 49 includes a sealed membrane 44 interposed the front chamber 18*b* of the inlet body 2 and another cavity 50 in the inlet body 2 adjacent to the regulating block 25. The device 49 further includes a control stem 42 extending between the membrane 44 and the channel 34 in the regulating block 25 and passing through the channel 38. A valve member 43 is provided at the end of the control stem 42 opposite the membrane 44 to selectively interconnect or seal the channels 38 and 34. The device 49 selectively places the conduit 32 in communication with the atmosphere through the adjustable relief jet 40 and the channels 34 and 38 when, under the effect of the pressure in the front chamber 18*b* of the inlet body 2, the sealed membrane 44 displaces, by means of the control stem 42, the valve member 43 normally held closed by a spring 41.

The operation of the inlet valve assembly is as follows.

Initially, the jack stem 19 is fully seated in the jack chamber 26 by the effect of the second return spring 28 interposed the shoulder 29 and the inlet body 2. The motor is in the accelerated position. The frusto-conical valve member 17 is biased against its frusto-conical seat under the effect of the first return spring 27.

As soon as the motor-compressor assembly is started, the frusto-conical valve member 17 opens, compressing the first return spring 27 under the effect of the suction created by the intake of the compressor 1. The pressure increases progressively in the oil separator 5.

If the quantity of air used by the tools connected to the compressor is equal to that delivered at maximum power by the screw compressor 1, the pressure existing in the oil separator 5 does not exceed the working pressure. The sealing disc 35 remains closed. No excess pressure exists in the jack chamber 26 and the jack stem 19 remains in its seated position under the effect of the second return spring 28.

Because of the pressure balance, the motor 15 remains in the accelerated position.

The circulation of oil intended to lubricate the screw compressor 1 is established along the oil return circuit 9 due to the difference of pressure between that existing in the oil separator 5 and the pressure which exists at the location of the injection of the oil into the screw compressor.

If the quantity of air used becomes lower than the maximum output of the compressor, the pressure increases progressively in the oil separator 5. As soon as the pressure reaches a value slightly larger than the maximum working pressure, the sealing disc 35 is lifted and the channel 33 is thereby placed in communication with the jack chamber 26 and the adjustable relief jet 40.

If, in addition, the relief output created by the adjustable relief jet 40 is insufficient, the pressure rises progressively in the jack chamber 26. The pressure thus exerted on the flexible sealed membrane 24 biases the jack stem 19 away from the jack chamber 26 overcoming the force of and compressing the second return spring 28. The motor is then slowed. Furthermore, the frusto-conical valve member 17 is driven towards the frusto-conical seat 16 and, thereby, reduces the minimum section of the inlet channel 2*a*, which in turn, reduces the volumetric flow rate of air drawn by the compressor.

The mobile assembly composed of the jack stem 19 and the frustoconical valve member 17 is thus displaced into a position of balance in which the volume of air supplied by the compressor corresponds to the volume used by varying the sectional area of the passageway between the chambers 18*a* and 18*b* of the inlet channel 2*a* and the rotation speed of the motor 15 which drives the screw compressor 1 directly.

If the consumption of compressed air becomes nil, the jack stem 19 is biased fully forward. The motor 15 is then totally decelerated to an idling condition and the supply of air to the inlet of the screw compressor 1 is almost completely blocked by the frusto-conical valve member 17.

If for any reason whatever the motor-compressor assembly stops, or is stopped, while an elevated pressure still exists in the oil separator 5, and the output valve 8 is closed, the pressure of the oil separator 5 sends oil through the screw compressor 1 towards the inlet. Immediately, the frusto-conical valve member 17 moves against its frusto-conical seat 16 under the effect of the first return spring 27. This happens irrespective of the position of the jack stem 19. The pressure progressively rises in the front chamber 18*b*, which has the consequence of increasing the force with which the frusto-conical valve member 17 bears on the frusto-conical seat 16, thus strengthening its seal and, thereby, preventing oil from returning to the inlet filter 3. At the same time the pressure existing in the front chamber 18*b* acts on the membrane 44 which, by means of the control stem 42, acts on the valve member 43. This opens the oil separator 5 to the atmosphere by means of the conduit 32 which then communicates with the atmosphere through the channels 34 and 38 and the adjustable relief jet 40, thus making the pressure existing in the oil separator 5 decrease until it approximately reaches the atmospheric pressure.

It will be seen that the device according to the present invention has several advantages.

The air-oil circuit and the oil circuit of the compressor are simplified. They no longer contain either an anti-return valve or an oil check valve.

No backflow of oil to the inlet filter is possible, even in the case when the motor-compressor or assembly is stopped while the oil separator 5 is still under pressure.

The regulation of the volume taken in by the compressor is precise, sensitive and stable, owing to the combined effect of the first and second return springs 27 and 28, respectively, thus avoiding any pumping phenomena on the jack stem 19.

The energy consumption of the motor-compressor assembly may be reduced to the strict minimum when there is no use of compressed air and when the assembly is idling, due to the good seal provided by the frusto-conical valve member 17.

The device of the present invention is in the form of a compact unit which may be assembled separately, and which, within the same block which is fixed to the inlet flange of the screw compressor 1, incorporates the functions of sealing the inlet in case of necessity; providing a proportional regulator; providing a control jack for the accelerator and the positive closing of the inlet valve supporting the air filter 3; emptying the separator 5; and providing a one-way valve 31 in the drain circuit of the filter cartridge 6 of the oil separator 5, thereby avoiding oil return into the cartridge in case of accumulation of oil in the front chamber 18*b*.

The foregoing description provides the best mode contemplated by the inventor at the time of filing for carrying out the present invention. Variations and modifications therefrom will be apparent to those skilled in the art and are intended to be within the scope of the claims appended hereto.

What is claimed as novel is as follows:

1. An intake regulator for a compressor having a compressor inlet, a compressor outlet, a compressor motor, and compressor means selectively operable to draw fluids from said inlet, pressure said fluid and direct said pressurized fluid to said compressor outlet, said regulator comprising:

a main body;

a main passageway extending through said main body and having a passageway inlet and a passageway outlet, said passageway outlet being interconnected with said compressor inlet for fluid flow therebetween;

valve means disposed along said main passageway selectively operable to close said main passageway, said valve means being biased upon in response to the operation of said compressor means;

a stem member movably mounted in said main passageway, said stem member having a first portion extending from and passing through said valve means, said stem member further having a second portion extending from said main body such that reciprocation of said second portion of said stem member controls the operation of said compressor motor;

abutment means disposed on said stem member;

biasing means for biasing said valve means towards a closed condition such that the amount of fluid flowing through said valve means is dependent on the suction created by said compressor means at said compressor inlet;

biasing means adjustment means selectively operable to adjust said biasing means in response to changes in the pressure at said compressor outlet; and a flexible diaphragm interposed said main passageway and said biasing means adjustment means, said abutment means being biased by said diaphragm against the force of said biasing means in response to the pressure level of said biasing means adjustment means.

2. The intake regulator of claim 1 wherein said valve means comprises:

a valve seat formed in said main body along said main passageway;

said stem member passing through said valve seat and interconnected with said main body; and a valve member reciprocably mounted to said stem member and selectively engageable with said valve seat.

3. The intake regulator of claim 2 further comprising:

a shoulder on said stem member, second biasing means interposed said shoulder and said main body biasing said stem member in a direction moving said valve member away from said valve seat; and selectively operable biasing means operable in response to said compressor outlet pressure to selectively bias said stem against the force of said second biasing means.

4. The intake regulator of claim 2 wherein said valve seat and said valve member are each frusto-conical in shape.

5. The intake regulator of claim 1 wherein said biasing means further comprises means for controlling the operation of said compressor means in response to the pressure at said compressor outlet.

6. The intake regulator of claim 1 wherein said biasing means adjustment means comprising:

sensing means sensing the pressure at said compressor outlet; and selectively operable actuation means responsive to a predetermined pressure level at said sensing means to adjust said biasing means.

7. The intake regulator of claim 1 wherein said biasing means adjustment means comprises:

a secondary valve body;

a control passageway partly through said secondary valve body and having an inlet at one of its ends and a cavity at the other of its ends;

conduit means interconnecting said inlet of said control passageway with said compressor outlet; and said flexible diaphragm disposed adjacent to said cavity for selective adjustment of said biasing means in response to the pressure in said cavity.

8. The intake regulator of claim 7 wherein said biasing means adjustment means further comprises a secondary valve means interposed said inlet and said cavity of said control passageway selectively operable to open in response to a pressure level in said conduit means in excess of a predetermined pressure level.

9. The intake regulator of claim 7 wherein said biasing means adjustment means further comprises selectively adjustable relief valve means interconnected with said cavity.

10. The intake regulator of claim 9 wherein said biasing means adjustment means further comprises secondary valve means selectively operable to interconnect said inlet of said control passageway with said relief means.

11. The intake regulator of claim 10 wherein said secondary valve means is operable in response to an increase of pressure in said main passageway beyond a predetermined pressure level.

12. The intake regulator of claim 2 wherein said biasing means adjustment means comprises:

a secondary valve body;

a control passageway partly through said secondary valve body and having an inlet at one of its ends and a cavity at the other of its ends;

conduit means interconnecting said inlet of said control passageway with said compressor outlet; and said flexible diaphragm disposed adjacent to said cavity for selective adjustment of said biasing means in response to the pressure in said cavity.

13. A servomechanical regulator for regulating the output of a compressor having a variable speed motor, a compressor interconnected with and driveny by said motor, an inlet for drawing fluid into said compressor, an outlet for delivery of pressurized fluid from said compressor, and a fluid supply interconnected with said inlet, said regulator comprising:

a main body interposed said fluid supply and said compressor inlet;

a main passageway extending through said main body and interconnected with said compressor inlet and said fluid supply for fluid flow therebetween along said main passageway;

a valve seat disposed along said main passageway;

a reciprocable stem member passing through said valve seat in said main passageway and having an abutment on one end of said stem member thereon, said stem member further being interconnected with said compressor such that reciprocation of said stem member controls the operation of said compressor motor;

a valve member reciprocably mounted to said stem member adjacent to said valve seat, said valve member being selectively operable to regulate the flow of fluid through said main passageway;

biasing means interposed said valve member and said abutment for biasing said valve member towards said valve seat;

biasing means adjustment means selectively operable to adjust said biasing means in response to changes in the pressure at said compressor outlet; and a flexible diaphragm interposed said biasing means adjustment means and said abutment on one end of said stem member, said flexible diaphragm being responsive to said biasing means adjustment means to adjust the position of said stem member.

14. The regulator of claim 13 further comprising a second abutment on said stem member and a second biasing means interposed said second abutment and said main body, said second biasing means biasing said stem member towards said flexible diaphragm.

15. The regulator of claim 13 wherein said biasing means adjustment means comprises:

a secondary valve body;

a control passageway partly through said secondary valve body and having an inlet at one of its ends and a cavity at the other of its ends, said cavity disposed adjacent to said flexible diaphragm for selective adjustment of said valve member in response to said biasing means adjustment means; and conduit means interconnecting said inlet of said control passageway with said compressor outlet.

16. The regulator of claim 15 further comprising secondary valve means interposed said inlet of said control passageway and said cavity of said control passageway selectively operable to open in response to a pressure level in said conduit means in excess of a predetermined pressure level.

17. The regulator of claim 15 further comprising selectively adjustable relief valve means interconnected with said cavity.

18. The regulator of claim 17 further comprising secondary valve means selectively operable to interconnect said inlet of said control passageway with said relief means in response to an increase in pressure in said main passageway beyond a predetermined level.

19. The regulator of claim 15 further comprising an oil pressure sensing means interposed said main passageway and said control passageway selectively operable to open in response to a pressure level in said main passageway in excess of a predetermined pressure level.

20. The regulator of claim 19 wherein said oil pressure sensing means is comprised of a flexible membrane acting on a second control stem and a second valve member.

* * * * *

UNITED STATES PATENT AND TRADEMARK OFFICE

CERTIFICATE OF CORRECTION

PATENT NO. : 4,515,515

DATED : May 7, 1985

INVENTOR(S) : Jean-Marc Segonne

It is certified that error appears in the above-identified patent and that said Letters Patent is hereby corrected as shown below:

Column 3, line 31, delete "connectesd" and insert ---- connected ----.

Column 3, line 37, delete "Beind the" and insert ---- Behind the ----.

Column 6, line 28, delete "upon" and insert ---- open ----.

Column 7, line 64, delete "driveny" and insert ---- driven ----.

Signed and Sealed this

*Tenth* Day of *September 1985*

[SEAL]

*Attest:*

DONALD J. QUIGG

*Attesting Officer* *Acting Commissioner of Patents and Trademarks - Designate*